US011610708B2

(12) United States Patent
Kim et al.

(10) Patent No.: US 11,610,708 B2
(45) Date of Patent: Mar. 21, 2023

(54) MAGNETIC FIELD APPLICATION DEVICE AND MAGNETIC FIELD APPLICATION SYSTEM INCLUDING THE SAME

(71) Applicant: AGENCY FOR DEFENSE DEVELOPMENT, Daejeon (KR)

(72) Inventors: Duk Young Kim, Daejeon (KR); Yong Sup Ihn, Daejeon (KR); Su-Yong Lee, Daejeon (KR); Dong Kyu Kim, Daejeon (KR); Taek Jeong, Daejeon (KR); Yonggi Jo, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 2 days.

(21) Appl. No.: 17/244,960

(22) Filed: Apr. 30, 2021

(65) Prior Publication Data

US 2021/0366639 A1 Nov. 25, 2021

(30) Foreign Application Priority Data

May 21, 2020 (KR) ..... 10-2020-0061145

(51) Int. Cl.
*H01H 47/00* (2006.01)
*H01F 7/20* (2006.01)
(Continued)

(52) U.S. Cl.
CPC ..... *H01F 7/20* (2013.01); *H01F 7/064* (2013.01); *H01F 10/24* (2013.01)

(58) Field of Classification Search
None
See application file for complete search history.

(56) References Cited

U.S. PATENT DOCUMENTS 4,456,895 A * 6/1984 Landt ..... H03H 7/0161 333/202
9,383,417 B2 7/2016 Jahns et al.
(Continued)

FOREIGN PATENT DOCUMENTS

| | | |
|---|---|---|
| JP | 2007-127582 | 5/2007 |
| KR | 10-2012-0110927 | 10/2012 |
| KR | 10-1813086 | 12/2017 |

OTHER PUBLICATIONS

Notice of Allowance dated Sep. 4, 2020 for Korean Patent Application No. 10-2020-0061145 and its English translation by Google Translate.

(Continued)

*Primary Examiner* — Stephen W Jackson
(74) *Attorney, Agent, or Firm* — Ladas & Parry, LLP

(57) ABSTRACT

A magnetic field application device according to an embodiment includes a first coil assembly and a second coil assembly spaced apart in parallel from each other, a power supply configured to apply respective currents to the first coil assembly and the second coil assembly, a controller, and a resonator accommodation unit disposed between the first coil assembly and the second coil assembly, wherein each of the first coil assembly and the second coil includes a coil configured to generate a magnetic field, a guide member connected to a terminal of the coil, a magnetic material mount connected to a terminal of the guide member, and a magnetic material fixed to the magnetic material mount, and wherein the controller is configured to control the currents applied from the power supply to the first coil assembly and the second coil assembly.

12 Claims, 16 Drawing Sheets

(51) Int. Cl.
*H01F 7/06* (2006.01)
*H01F 10/24* (2006.01)

(56) References Cited

U.S. PATENT DOCUMENTS

| | | | | |
|---|---|---|---|---|
| 2009/0196074 | A1* | 8/2009 | Choi | H02M 3/33571 363/21.02 |
| 2010/0127659 | A1* | 5/2010 | Klinghult | H02J 50/12 343/702 |
| 2018/0113373 | A1 | 4/2018 | Witmer et al. | |

OTHER PUBLICATIONS

Office Action dated Jul. 10, 2020 for Korean Patent Application No. 10-2020-0061145 and its English translation by Google Translate.

* cited by examiner

MAGNETIC FIELD APPLICATION DEVICE AND MAGNETIC FIELD APPLICATION SYSTEM INCLUDING THE SAME

CROSS-REFERENCE TO RELATED APPLICATION

This application is based on and claims priority under 35 U.S.C. § 119 to Korean Patent Application No. 10-2020-0061145, filed on May 21, 2020, in the Korean Intellectual Property Office, the disclosure of which is incorporated by reference herein in its entirety.

BACKGROUND

1. Field

The present disclosure relates to a magnetic field application device and a magnetic field application system including the same, and more particularly, to a magnetic field application device for quantum frequency conversion between a microwave and an optical wave, and a magnetic field application system including the same.

2. Description of the Related Art

A technology for coupling a spin mode (or Kittel mode) with a microwave mode using a ferromagnetic material and a microwave resonator is a technology in advance for mutually coherent conversion between a microwave photon and an optical-frequency photon. Quantum frequency conversion between a microwave and an optical wave is a core technology for developing a quantum radar.

SUMMARY

The present disclosure provides a magnetic field application device that may generate a magnetic field having the slope as well as a linear change therein with respect to a supplied current, and a magnetic field application system that enables quantum coupling and multi-mode quantum frequency conversion between a ferromagnetic material spin mode and a microwave resonator mode (or microwave cavity mode) using the magnetic field application device.

The objects of the present invention are not limited to the aforementioned objects, and other objects which are not described herein should be clearly understood by those skilled in the art from the following detailed description and the accompanying drawings.

Additional aspects will be set forth in part in the description which follows and, in part, will be apparent from the description, or may be learned by practice of the presented embodiments of the disclosure.

According to an aspect of the present invention, there is provided a magnetic field application device including: a first coil assembly and a second coil assembly spaced apart in parallel from each other; a power supply configured to apply respective currents to the first coil assembly and the second coil assembly; a controller; and a resonator accommodation unit disposed between the first coil assembly and the second coil assembly, wherein the controller may controls the currents applied from the power supply to the first coil assembly and the second coil assembly.

Each of the first coil assembly and the second coil may include: a coil configured to generate a magnetic field; a guide member connected to a terminal of the coil; a magnetic material mount connected to a terminal of the guide member; and a magnetic material fixed to the magnetic material mount.

The magnetic field application device may further include: a base in which the resonator accommodation unit is formed; and a support unit disposed on a top portion of the base to support the first coil assembly and the second coil assembly, wherein respective coils of the first coil assembly and the second coil assembly are coaxial.

The first coil assembly and the second coil assembly may be symmetrically arranged on the basis of the resonator accommodation unit.

The controller may be able to independently control the respective currents applied to the first coil assembly and the second coil assembly.

According to another aspect of the present invention, there is provided a magnetic field application system including: any one of the above-described magnetic field application devices; and a resonator disposed in the cavity accommodation unit of the magnetic field application device, wherein the resonator includes: a main body; a penetration opening formed in the main body; and an Yttrium Iron Garnet single crystal disposed in the penetration opening, wherein the penetration opening of the resonator is disposed between the first coil assembly and the second coil assembly of the magnetic field application device.

The resonator may receive inputs and outputs of the microwave and the optical wave, and cause frequency conversion between the microwave and the optical wave to occur by the magnetic field generated by the magnetic field application device.

The resonator may further include: a microwave input and output unit configured to receive the input and output of the microwave; an optical wave input unit configured to receive an input of the optical wave; and an optical wave output unit configured to output the frequency-converted optical wave.

The resonator may include a plurality of Yttrium Iron Garnet (YIG) single crystals, wherein the plurality of YIG single crystals are arranged in parallel in a direction from one between the first coil assembly and the second coil assembly toward another.

In the resonator, a frequency conversion band between the microwave and the optical wave may be adjusted according to 3-D dimensions of the main body.

The controller may apply respective different currents to the first coil assembly and the second coil assembly to adjust a slope of the magnetic field applied to the resonator.

The magnetic field application device may further include: temperature sensors configured to sense temperatures of respective coils in the first coil assembly and the second coil assembly, wherein the controller adjusts an amount of generation of the magnetic field on the basis of the temperatures sensed by the temperature sensors.

The controller may control the currents applied to the first coil assembly and the second coil assembly so that a resonant frequency of the resonator is constant.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1A:
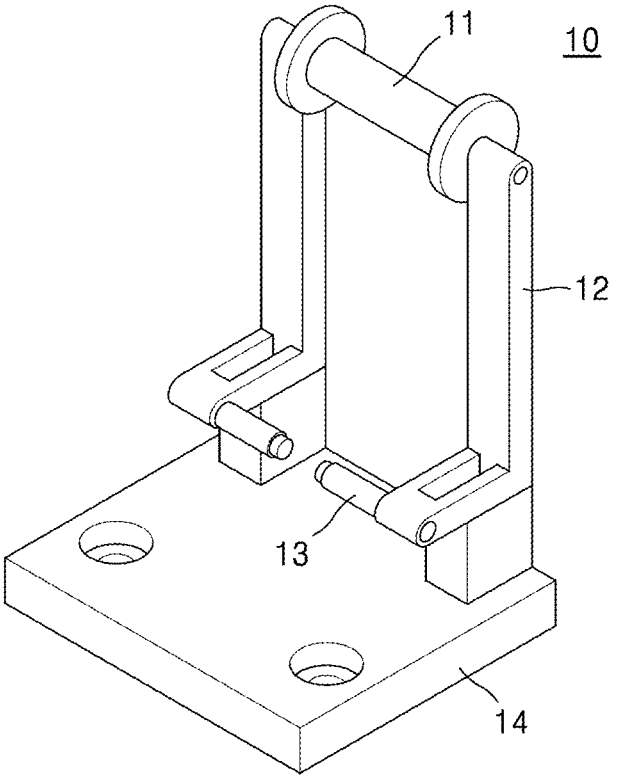
FIG. 1A is a perspective view illustrating a previous magnetic field device.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

The present invention will now be described more fully with reference to the accompanying drawings, in which exemplary embodiments of the invention are shown. However technical concepts of the invention are not limited within the proposed embodiments. On the contrary, by addition of other constituting elements, change or deletion of the constituting elements from the present invention, another retrogressive invention or other embodiments that fall within the scope of the present invention can be easily suggested.

Also, the same or similar reference numerals provided in each drawing denote the same or similar components.

Although terminologies used in the present specification are selected from general terminologies used currently and widely in consideration of functions, they may be changed in accordance with intentions of technicians engaged in the corresponding fields, customs, advents of new technologies and the like. Occasionally, some terminologies may be arbitrarily selected by the applicant. In this case, the meanings of the arbitrarily selected terminologies shall be defined in the relevant part of the detailed description. Accordingly, the specific terms used herein should be understood based on the unique meanings thereof and the whole context of the present invention.

In addition, when an element is referred to as "comprising" or "including" a component, it does not preclude another component but may further include the other component unless the context clearly indicates otherwise. The term "-unit", "-module" or the like means a unit configured to process at least one function or operation, and this may be implemented in hardware or software, or implemented by combining hardware and software.

Hereinafter, embodiments of the present invention will be described in detail with reference to the accompanying drawings so that the present invention can be easily realized by those skilled in the art. The present invention can be practiced in various ways and is not limited to the embodiments described herein.

Figure 1B:
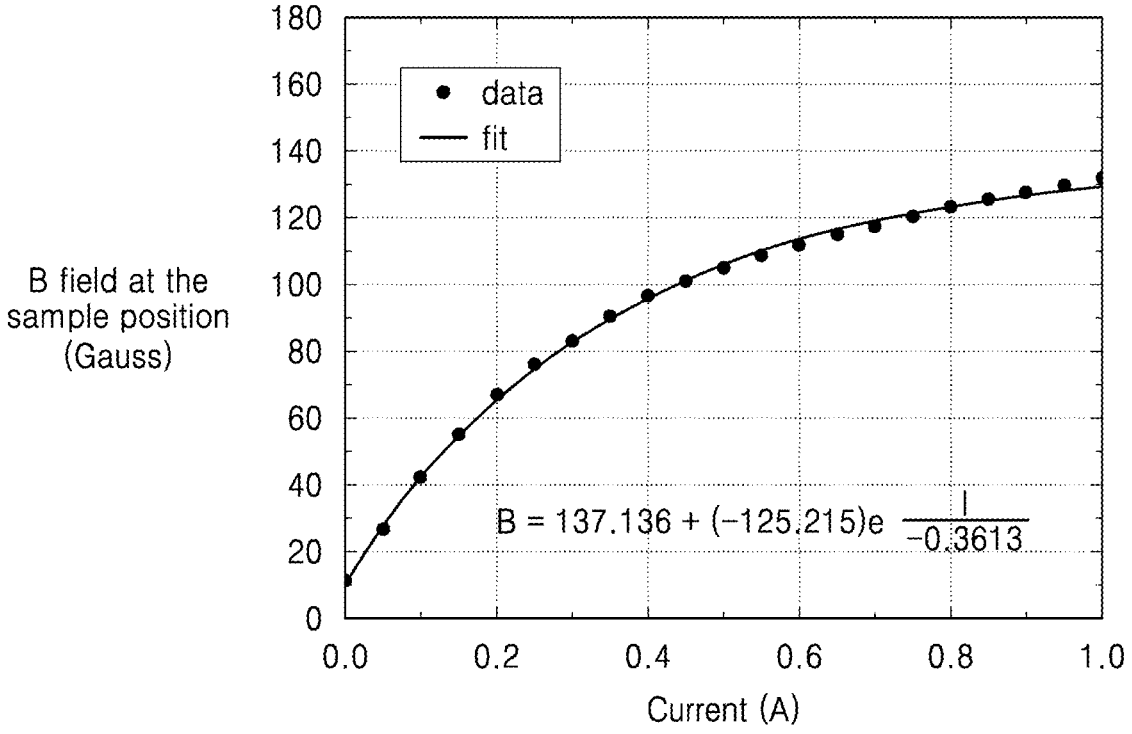
FIG. 1B is a graph showing the strength of a magnetic field generated according to a current supplied to the magnetic field device illustrated in FIG. 1A.

FIG. 1A is a perspective view illustrating a previous magnetic field device, and FIG. 1B is a graph showing the strength of a magnetic field generated according to a current supplied to the magnetic device illustrated in FIG. 1A.

Referring to FIG. 1A, the typical magnetic field device 10 includes a solenoid coil 11, a yoke 12, and guides 13. A sample (not shown) to be disposed in the magnetic field device 10 is to be in between guides 13.

Since the distance between the solenoid coil 11 and the sample is long and the magnetic field actually applied at a sample position is reduced ten times in comparison to a magnetic field generated by the solenoid coil 11, the magnetic field device 10 does not effectively apply the magnetic field.

Referring to FIG. 1B, when the number of windings (—3000) of the solenoid coil 11 increases in order to supply a sufficient magnetic field at the sample position, a resistance value of the yoke made of pure iron changes due to heat generated by the solenoid coil 11. Accordingly, it may be seen that the strength of the magnetic field according to the current supplied to the magnetic field device 10 does not increase linearly. This reduces predictability fora value of the magnetic field to be applied. In addition, since a change in temperature of the generated heat changes the applied magnetic field due to such inefficiency, a fluctuation of a resonant frequency is caused for an Yttrium Iron Garnet (YIG) single crystal of the sample.

Figure 2:
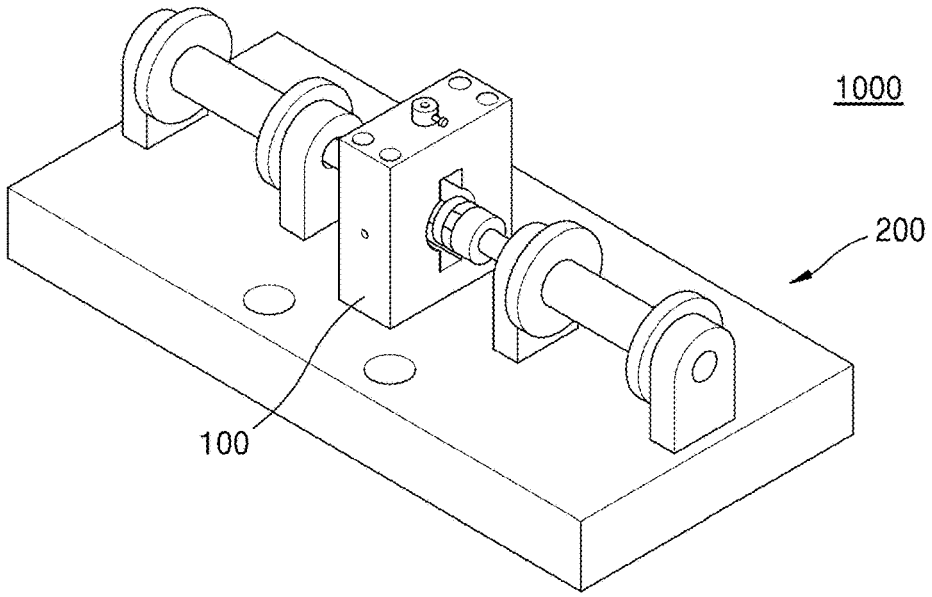
FIG. 2 is a perspective view illustrating a magnetic field application system according to an embodiment.

FIG. 2 is a perspective view illustrating a magnetic field application system according to an embodiment.

Referring to FIG. 2, the magnetic field application system 1000 may include a resonator 100 and a magnetic field application device 200.

The magnetic field application system 1000 uses a coupling technology of a spin mode (or Kittel mode) and a microwave mode, which uses a ferromagnetic material and a microwave resonator. Fundamentally, the YIG (i.e., Yttrium Iron Garnet) single crystal, which is a ferromagnetic material, is fixed at a point at which an AC magnetic field distribution in the microwave resonator becomes maximum and thus an optical wave (a microwave) may be converted (inversely converted) to/from the microwave (the optical wave) by mutually coherent interaction between a microwave resonance mode and a ferromagnetic spin mode.

A coupling Hamiltonian between the microwave resonator and spin ensemble due to a quantum electrodynamics effect is given as the following:

$$\hat{H}_I = \hbar g_{eff}(\hat{a}^+\hat{c} + \hat{a}\hat{c}^+) \quad \text{[Equation 1]}$$

$$g_{eff} = \frac{g\mu_B B_0}{2\hbar}\sqrt[2]{2_S N}$$

In Equation 1, $\hat{a}$ and $\hat{c}$ are quantum mechanical operators that respectively denote the microwave resonator mode (or microwave cavity mode) and the spin mode. g denotes a g-factor, $\mu_B$ denotes a Bohr magneton, and $B_0$ denotes a microwave magnetic field in the resonator mode (or cavity mode). s and N respectively denote a spin and the total number of spins.

The YIG used in the magnetic field application system 1000 is a ferromagnetic material, the spin density of which being $2.1\times10^{22}\mu_B cm^{-3}$ that is very larger than $10^{16}\sim10^{18}\mu_B cm^{-3}$ of another diamagnetic spin ensemble, and thus a strong coupling effect with an electromagnetic wave may be obtained. In order to control the coupling of the microwave resonator mode and the spin mode in the magnetic field application system 1000 composed of such a resonator and the YIG, it is required to externally apply a DC magnetic field to obtain a resonator frequency according to the resonant frequency of the YIG and a change in the external magnetic field.

There exist a number of spins (electronic spins around an iron atom core) in the YIG. Here, according to the magnitude of a static magnetic field applied externally, there are various forms of magnon modes (quantized vibration modes of spins), and the resonant frequencies vary for respective modes. Accordingly, when a larger magnetic field is applied to the YIG, a magnon mode at a higher resonant frequency may be implemented.

A magnetic field application device 200 in the magnetic field application system 1000 applies a microwave to the resonator 100 and changes a Zeeman level of the YIG according to the strength of the external magnetic field. Here, it may be confirmed that the resonator mode is coupled to the spin mode by obtaining the resonant frequency of the resonator mode and the spin mode with a two-dimensional transmission spectrum. Transmission coefficients of such a coupling system may be given as the following.

$$S_{12}(\omega) = \frac{\sqrt[2]{k_1 k_2}}{i(\omega-\omega_c) - \frac{k_1+k_2+k_i}{2} + \frac{|g_m|^2}{i(\omega-\omega_{FMR}) - \gamma_m/2}} \quad \text{[Equation 2]}$$

In Equation 2, $\omega_c$ denotes the resonant frequency of the microwave resonator, $k_i$ denotes a loss of an internal resonator, and $k_1$ and $k_2$ respectively correspond to the coupling strengths of input and output terminals. Furthermore, $g_m$ denotes a coupling strength of the spin mode and the resonator, and $\omega_{FMR}$ and $\gamma_m$ respectively denote a frequency and a linewidth of the spin mode.

Hereinafter, the resonator 100 and the magnetic field application device 200 in the magnetic field application system 1000 according to an embodiment will be described in detail.

Figure 3:
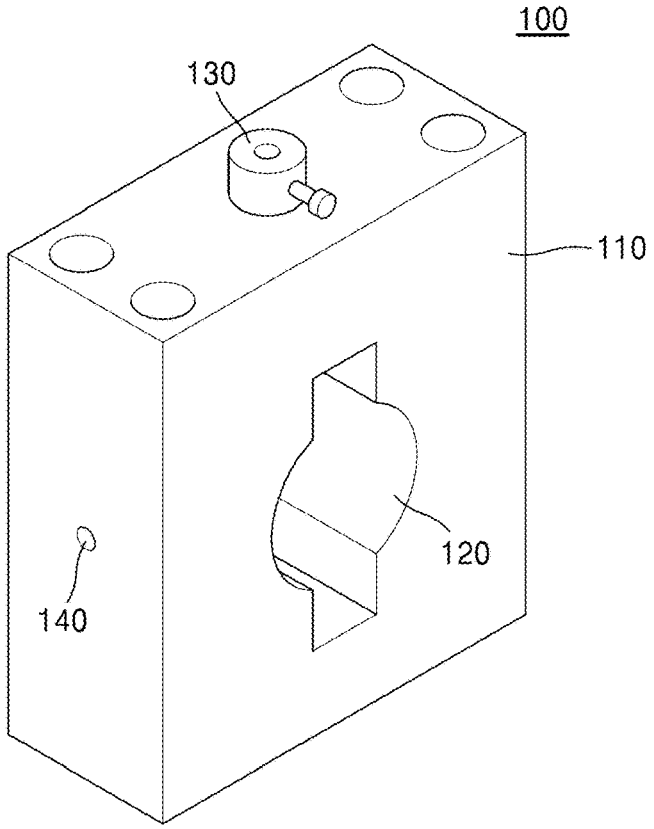
FIG. 3 is a perspective view of a resonator of the magnetic field application system illustrated in FIG. 2.

FIG. 3 is a perspective view of a resonator of the magnetic field application system illustrated in FIG. 2.

Referring to FIG. 3, the resonator 100 may include a main body 110, an penetration opening 120, a microwave input and output unit 130, and an optical wave input unit 140.

The main body 110 may have a rectangular parallelepiped shape as shown in FIG. 3, and may be manufactured with copper (Cu). However, this is an exemplary shape and material, and the main body 110 may be manufactured in another shape and with another material.

The penetration opening 120 may be formed in the central part of the main body 110. The magnetic field from the magnetic field application device 200, which will be described later, may penetrate the penetration opening 120 to be formed. Although not shown in FIG. 3, a YIG single crystal may be disposed inside the penetration opening 120. For example, the YIC single crystal may be positioned at a point at which a magnetic field distribution is the largest in the resonator 100.

In addition, the YIG single crystal may be in plural. The plurality of YIG single crystals may be arranged in parallel in a direction from one toward the other between a first coil assembly and a second coil assembly of the magnetic field application device 200, which will be described later. In other words, the plurality of YIG single crystals may be arranged in parallel along the penetration opening 120.

The resonator 100 may receive inputs and outputs of the microwave and the optical wave. For example, the microwave input and output unit 130 may receive an input and output of the microwave, and the optical wave input unit 140 may receive an input of the optical wave. In addition, as described in the following, the resonator 100 may include an optical wave output unit (not shown) configured to output a frequency-converted optical wave.

Figure 4A:
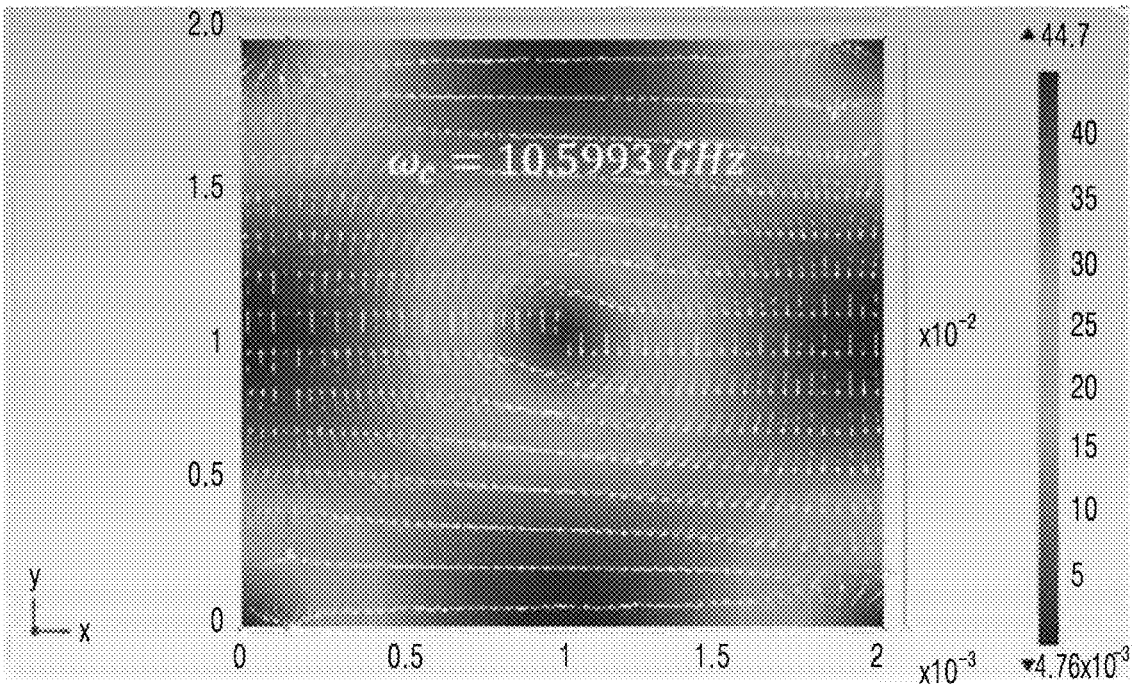
FIG. 4A illustrates simulation of a microwave magnetic field distribution in $TE_{101}$ mode of the resonator illustrated in FIG. 3.
Figure 4B:
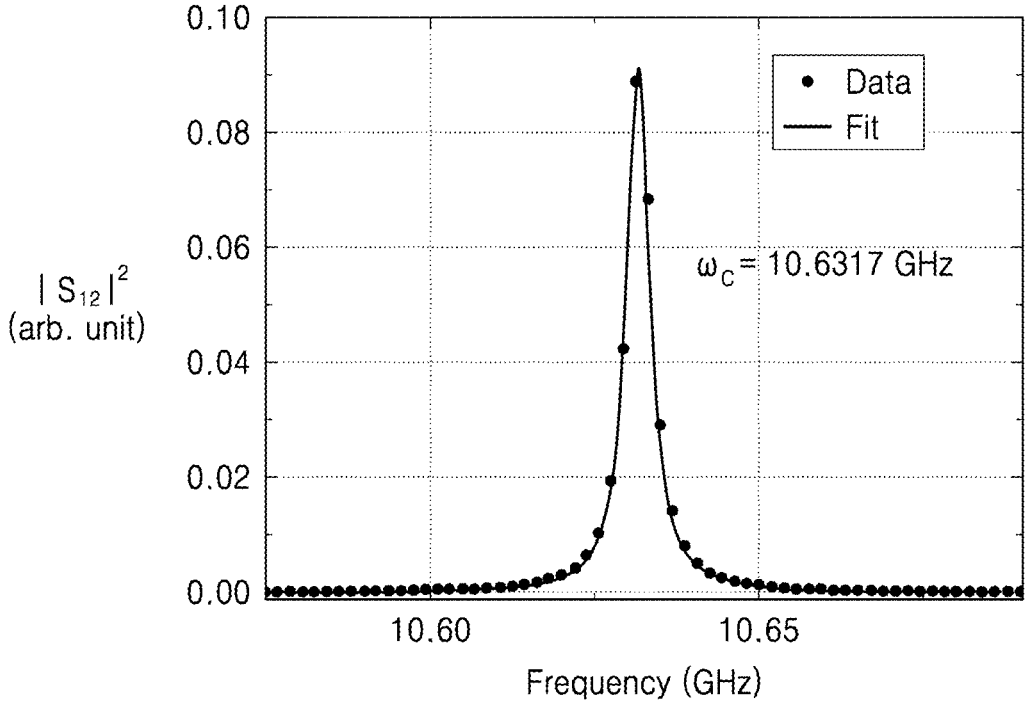
FIG. 4B is a graph showing a transmission spectrum of the resonator shown in FIG. 3.
Figure 4C:
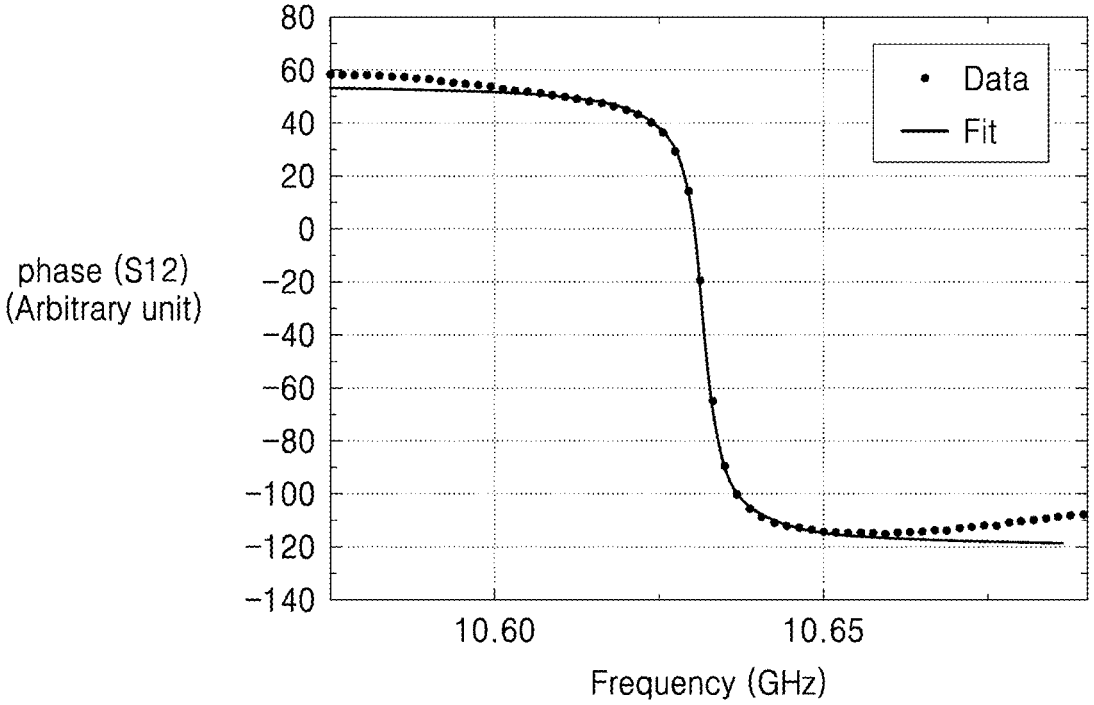
FIG. 4C is a graph showing phase data points of the resonator shown in FIG. 3 and a logistic curve according thereto.

FIG. 4A illustrates a simulation of a microwave magnetic field distribution in $TE_{101}$ mode of the resonator shown in FIG. 3, FIG. 4B is a graph showing a transmission spectrum of the resonator shown in FIG. 3, and FIG. 4C is a graph showing phase data points of the resonator shown in FIG. 3 and a logistic curve according thereto.

Referring to FIGS. 4A to 4C, the resonant frequency $\omega_c$ measured in the resonator 100 shown in FIG. 3 is $2\pi\times10.6317$ GHz, and it may be seen to be almost the same as $2\pi\times10.5993$ GHz that is a theoretical value obtained from the simulation. Respective coupling strengths $k_1$ and $k_2$ of input and output ports of the microwave input and output unit 130 may be $2\pi\times1.0$ MHz and $2\pi\times0.4$ MHz respectively, and an internal loss of the resonator 100 exhibits $2\pi\times2.8$ MHz.

Figure 5:
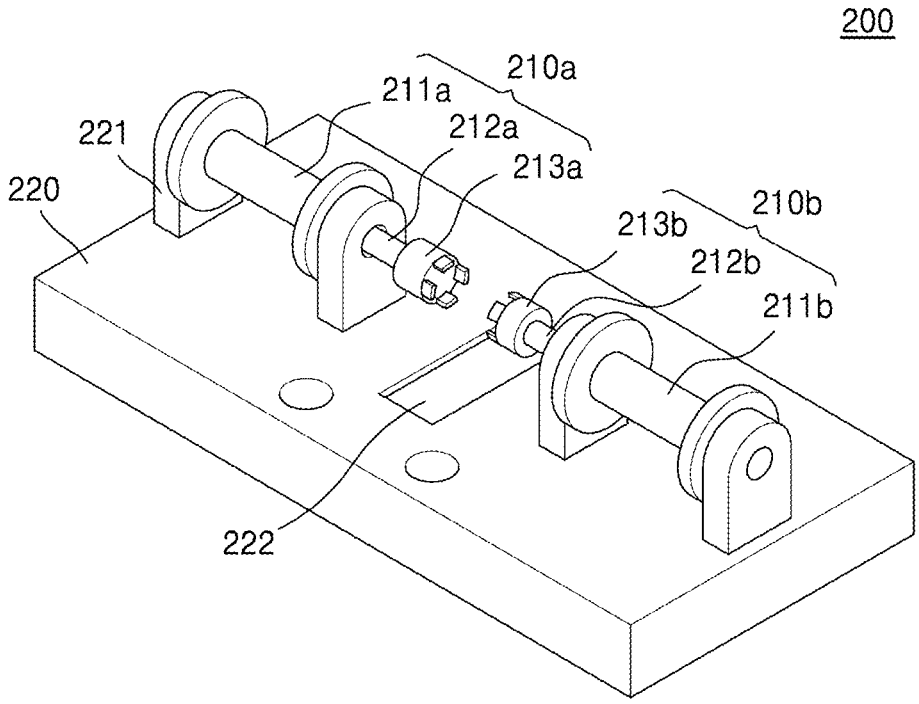
FIG. 5 is a perspective view of a magnetic field application device of the magnetic field application system illustrated in FIG. 2.
Figure 6:
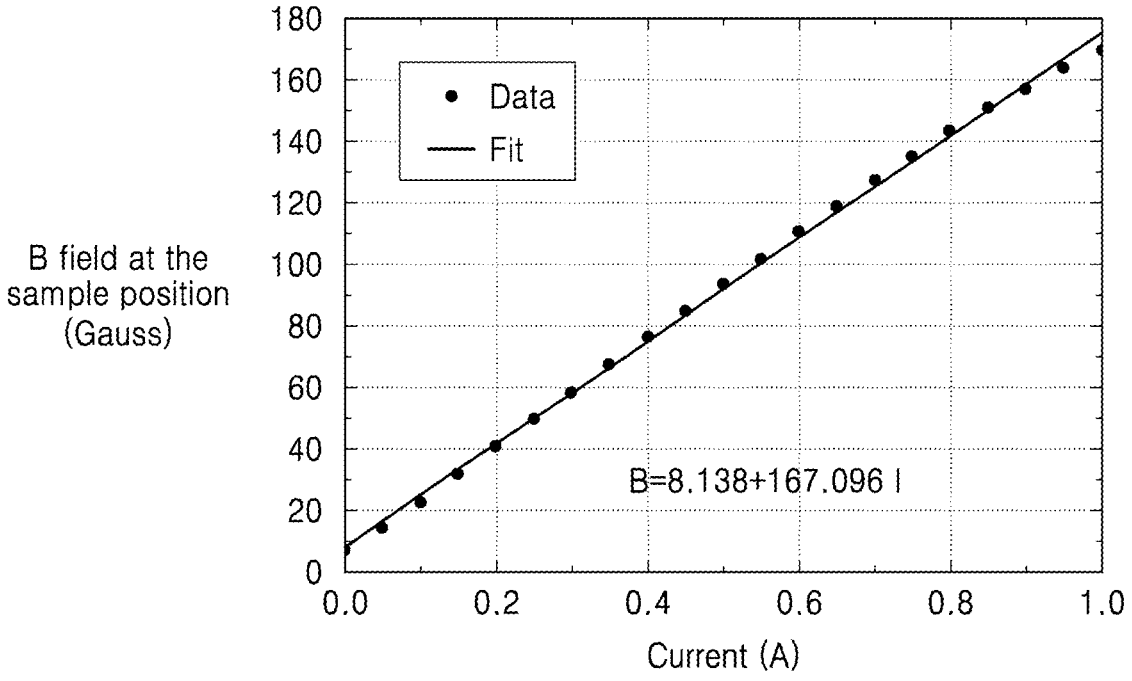
FIG. 6 is a graph showing the strength of a magnetic field generated according to a current supplied to the magnetic field device illustrated in FIG. 5.

FIG. 5 is a perspective view illustrating the magnetic field application device in the magnetic field application system shown in FIG. 2, and FIG. 6 is a graph showing the strength of a magnetic field generated according to a current supplied to the magnetic field device shown in FIG. 5.

Referring to FIG. 5, the magnetic field application device 200 includes a first coil assembly 210*a*, a second coil assembly 210*b*, a base 200, a support unit 221, and a resonator accommodation unit 222.

The first coil assembly 210*a* and the second coil assembly 210*b* may be spaced apart from each other in parallel. The base 220 supports each element of the magnetic field application device 200. The support unit 221 supports the first coil assembly 210*a* and the second coil assembly 210*b* to fix the positions thereof. In addition, the resonator accommodation unit 222 is formed in the base 220, and disposed between the first coil assembly 210*a* and the second coil assembly 210*b* to decide the position at which the resonator 100 is to be accommodated. For example, the first coil assembly 210*a* and the second coil assembly 210*b* may be symmetrically arranged on the basis of the resonator accommodation unit 222. Accordingly, as shown in FIG. 2, the penetration opening 120 of the resonator 100 may be positioned between the first coil assembly 210*a* and the second coil assembly 210*b*.

Meanwhile, although not shown in FIG. 5, the magnetic field application device 200 may include a power supply that may apply respective currents to the first coil assembly 210*a* and the second coil assembly 210*b*, and a controller that may control the currents to be respectively applied from the power supply to the first coil assembly 210*a* and the second coil assembly 210*b*.

The first coil assembly 210*a* includes a coil 211*a*, a guide member 212*a*, a magnetic material mount 213*a*, and a magnetic material 214*a*. The coil 211*a* generates a magnetic field with the current applied from the power supply. The guide member 212*a* is connected to a terminal of the coil 211*a* to deliver the magnetic field generated by the coil 211*a*. The magnetic material mount 213*a* is connected to a terminal of the guide member 212*a*, and fixes the magnetic material 214*a*.

The second coil assembly 210*b* includes the same configuration as the first coil assembly 210*a*, and, as described above, is spaced apart from and in parallel with the first coil assembly 210*a*. For example, the first coil assembly 210*a* and the second coil assembly 210*b* may be arranged coaxially with each other, and accordingly, respective coils 211*a* and 211*b* of the first coil assembly 210*a* and the second coil assembly 210*b* may be coaxial with each other.

Accordingly, the two coils 211*a* and 211*b* are disposed symmetrically from the position of the resonator 100, so that the magnetic field application device 200 may apply uniformly the magnetic field to the YIG positioned at the center of the resonator 100.

Meanwhile, although not shown in FIG. 5, the magnetic field application device 200 may include temperature sensors that respectively sense the temperatures of the coils 211*a* and 211*b* of the first coil assembly 210*a* and a second coil assembly 210*b*. The controller of the magnetic field application device 200 may adjust an amount of generation of the magnetic field on the basis of the temperatures sensed by the temperature sensors.

The controller may control the currents applied to the respective coils 211*a* and 211*b* of the first coil assembly 210*a* and the second coil assembly 210*b* so that the resonant frequency of the resonator 100 is constant. Here, the meaning of controlling the currents may mean to control, for example, the intensities of the currents applied to the coils 211*a* and 211*b*, and a time, a period, or the like at which the currents are applied.

As described above, when the currents are applied to the coils 211*a* and 211*b*, heat may be generated to change the temperatures of the coils 211*a* and 211*b*. The changes in the temperatures may change the magnetic field applied by the coils to cause the resonant frequency of the YIG single crystal to fluctuate. In other words, as the above-described embodiments, the magnetic field application device 200 may maintain the generation amount of the magnetic field constant by controlling the currents applied to the coils 211*a* and 211*b* by means of the temperature sensors. Accordingly, the magnetic field application device 200 may also maintain the resonant frequency of the YIG single crystal of the resonator 100 constant.

Referring to FIG. 6, illustrated is the strength of the magnetic field according to the currents applied to the coils 211*a* and 211*b* at the position (namely, the sample position) of the resonator accommodation unit 222 in the magnetic field application device 200. In comparison to FIG. 1B showing the strength of the magnetic field generated according to the current supplied by the magnetic field device 10, it may be seen that the magnetic field increases linearly according to the applied current at the sample position in the magnetic field application device 200 according to an embodiment.

Meanwhile, the controller of the magnetic field application device 200 may independently control the current applied to each of the first coil assembly 210*a* and the second coil assembly 210*b*. For example, the controller may apply the same current to the first coil assembly 210*a* and the second coil assembly 210*b*. In addition, the controller may apply different currents to the first coil assembly 210*a* and the second coil assembly 210*b*. The controller of the magnetic field application device 200 may apply the different currents to the first coil assembly 210*a* and the second coil assembly 210*b*, and thus the slope of the magnetic field applied to the resonator 100 may be adjusted.

Figure 7A:
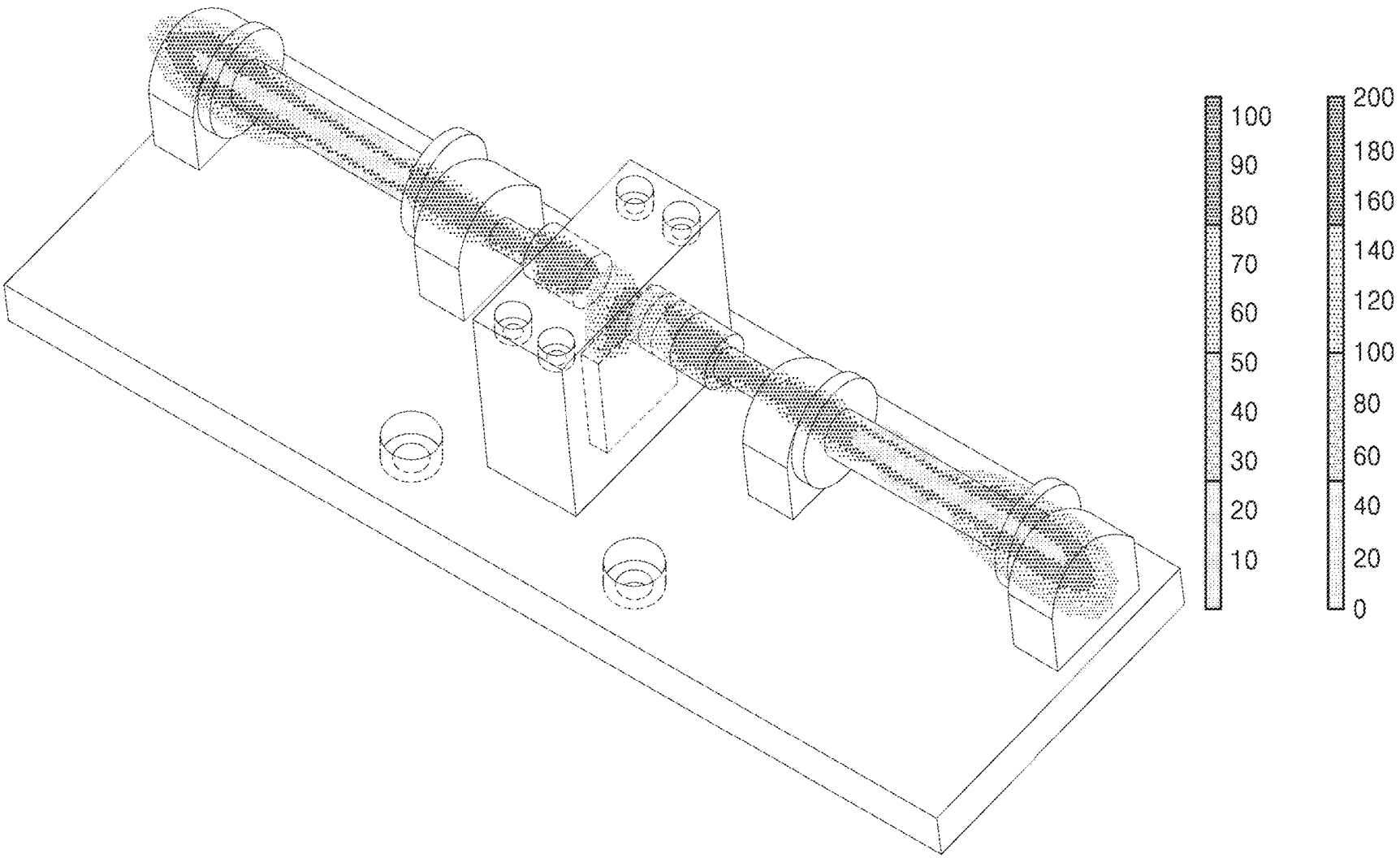
FIG. 7A illustrates a magnetic field distribution generated when the same current is applied to a pair of coil assemblies of the magnetic field device shown in FIG. 5.
Figure 7B:
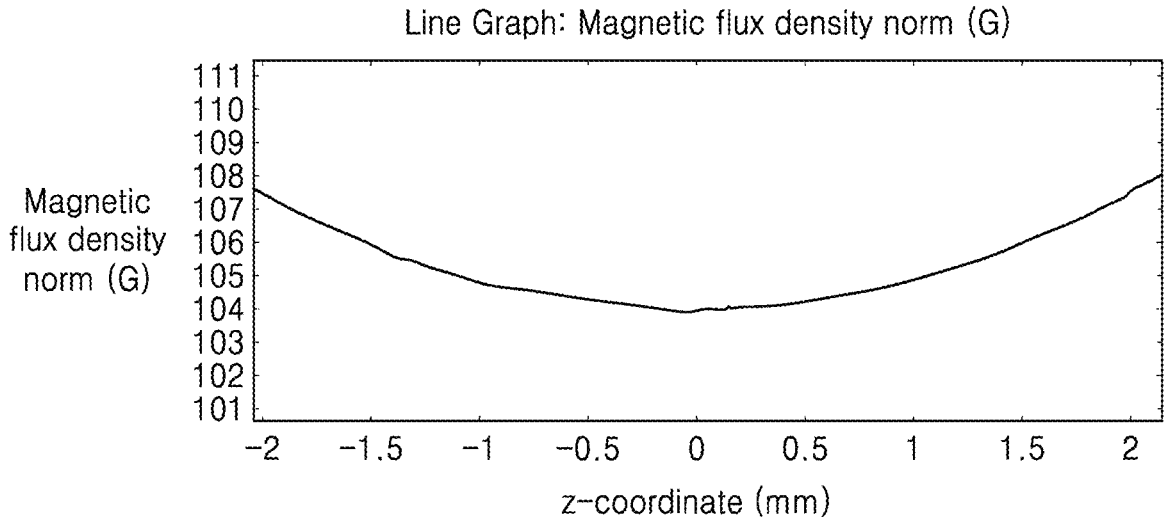
FIG. 7B is a graph showing a magnetic field distribution shown in FIG. 7A.

FIG. 7A illustrates a distribution of the magnetic field generated when the same current is applied to the pair of coil assemblies in the magnetic field device shown in FIG. 5, and FIG. 7B is a graph showing the magnetic field distribution shown in FIG. 7A.

Referring to FIGS. 7A and 7B, it is shown that the magnetic field distribution generated by the magnetic field application device 200 is symmetric due to the application of the same current to the two coil assemblies 210*a* and 210*b*.

Figure 8A:
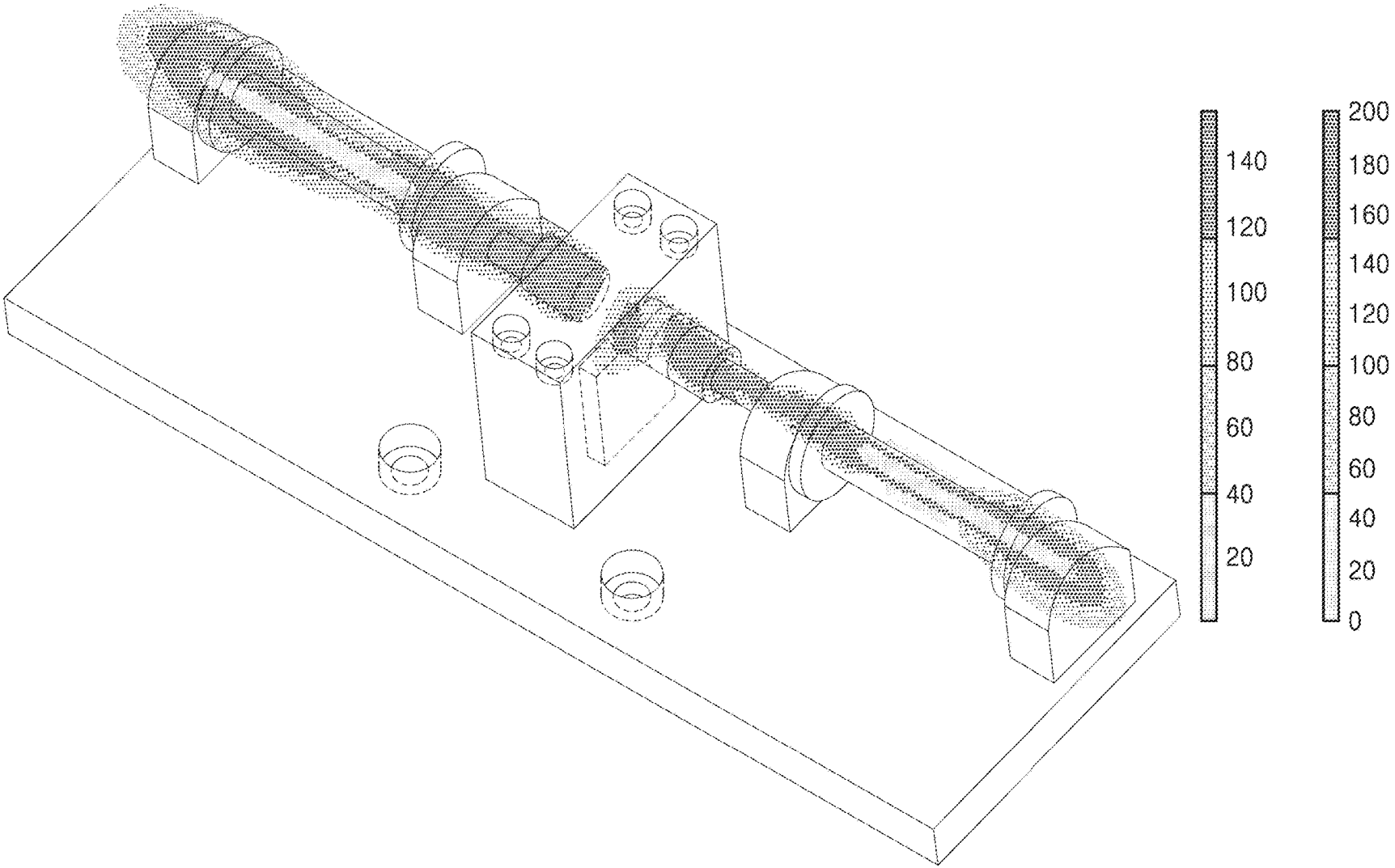
FIG. 8A illustrates a magnetic field distribution generated when different currents are applied to the pair of coil assemblies of the magnetic field device shown in FIG. 5.
Figure 8B:
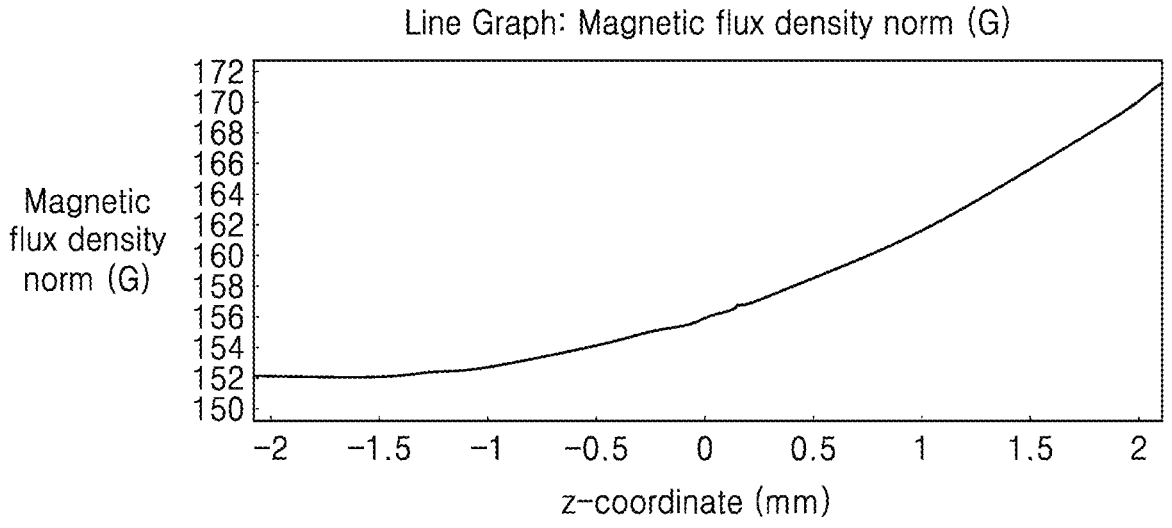
FIG. 8B is a graph showing the magnetic field distribution shown in FIG. 8A.
Figure 8C:
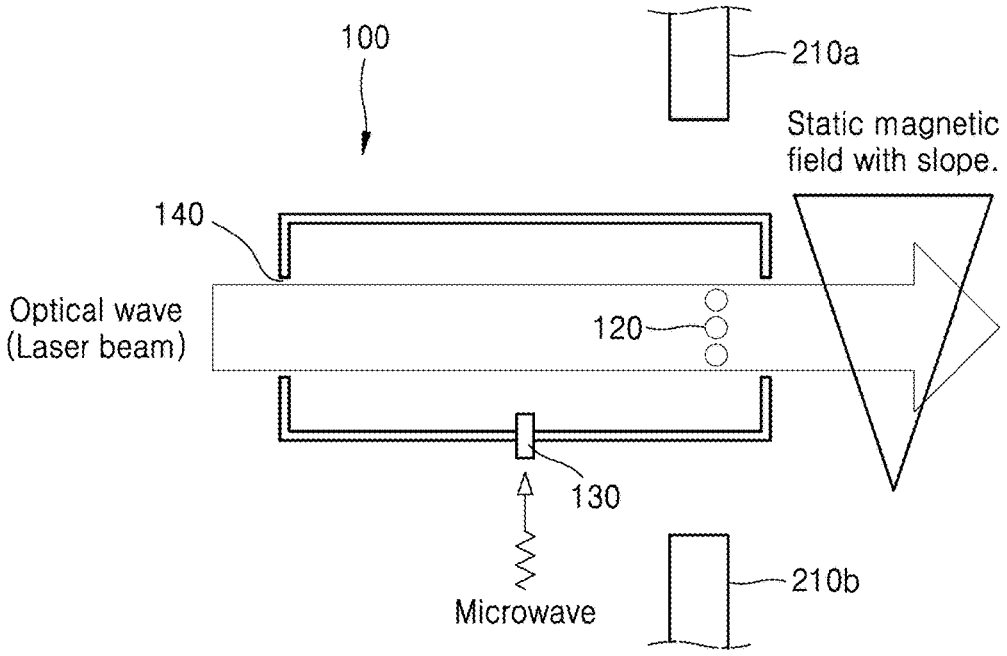
FIG. 8C is a conceptual diagram of quantum frequency conversion based on a multi-magnon mode using asymmetrical magnetic field shown in FIG. 8A.

FIG. 8A illustrates a magnetic field distribution generated when different currents are applied to the pair of coil assemblies of the magnetic field device shown in FIG. 5, FIG. 8B is a graph showing the magnetic field distribution shown in FIG. 8A, and FIG. 8C is a conceptual diagram of quantum frequency conversion based on a multi-magnon mode using asymmetrical magnetic field shown in FIG. 8A.

Referring to FIGS. 8A and 8B, it is shown that the magnetic field distribution generated by the magnetic field application device 200 is asymmetric due to the application of the different currents to the two coil assemblies 210*a* and 210*b*, and it may be seen that the magnetic field has the slope in an axial direction.

Referring to FIG. 8C, the magnetic field is generated from the first coil assembly 210 and the second coil assembly 201*b* of the magnetic field application device 200, and, the two coil assemblies 210 and 210*b* generate the asymmetric magnetic field. The YIG single crystal is disposed to be positioned at a point at which the magnetic field distribution generated from the first coil assembly 210*a* and the second coil assembly 210*b* is the largest in the resonator 100. For example, a plurality of YIG single crystals in the embodiment shown in FIG. 8C may be arranged in parallel in a direction from one of the first coil assembly 210*a* and the second coil assembly 210*b* toward the other.

The resonator 100 receives an optical wave from the optical wave input unit 140, and the optical wave penetrates through the YIG. In addition, the resonator 100 may receive a microwave from the microwave input and output unit 130.

For example, since a gyro ratio of the YIG is about 2.8 MHz/Gauss, when a difference of about 7 Gauss per 1 mm is generated, a magnon resonance mode generated from the YIG would be generated at an interval of about 20 MHz. In considering that a measured linewidth of the resonance mode of the YIG having the diameter of 0.45 mm is narrower than about 4 MHz, a multi-magnon mode may be sufficiently distinguished. FIG. 8C shows that, when an YIG sphere having a smaller diameter and a narrower linewidth is made using such characteristics, multi-mode quantum frequency conversion may be sufficiently implemented. Meanwhile, the above numerical values are only exemplary, and the embodiments are not limited by the numerical values.

Figure 9:
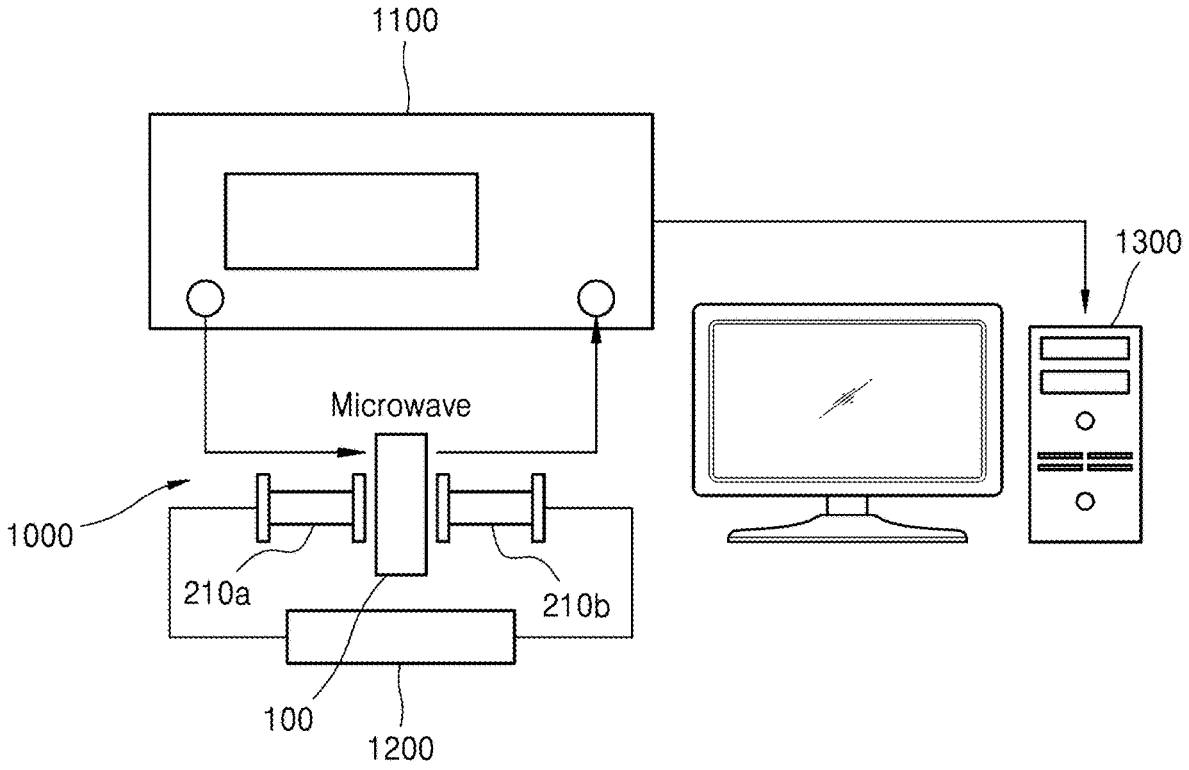
FIG. 9 is a conceptual diagram of a magnetic field application system according to an embodiment shown in FIG. 2.
Figure 10A:
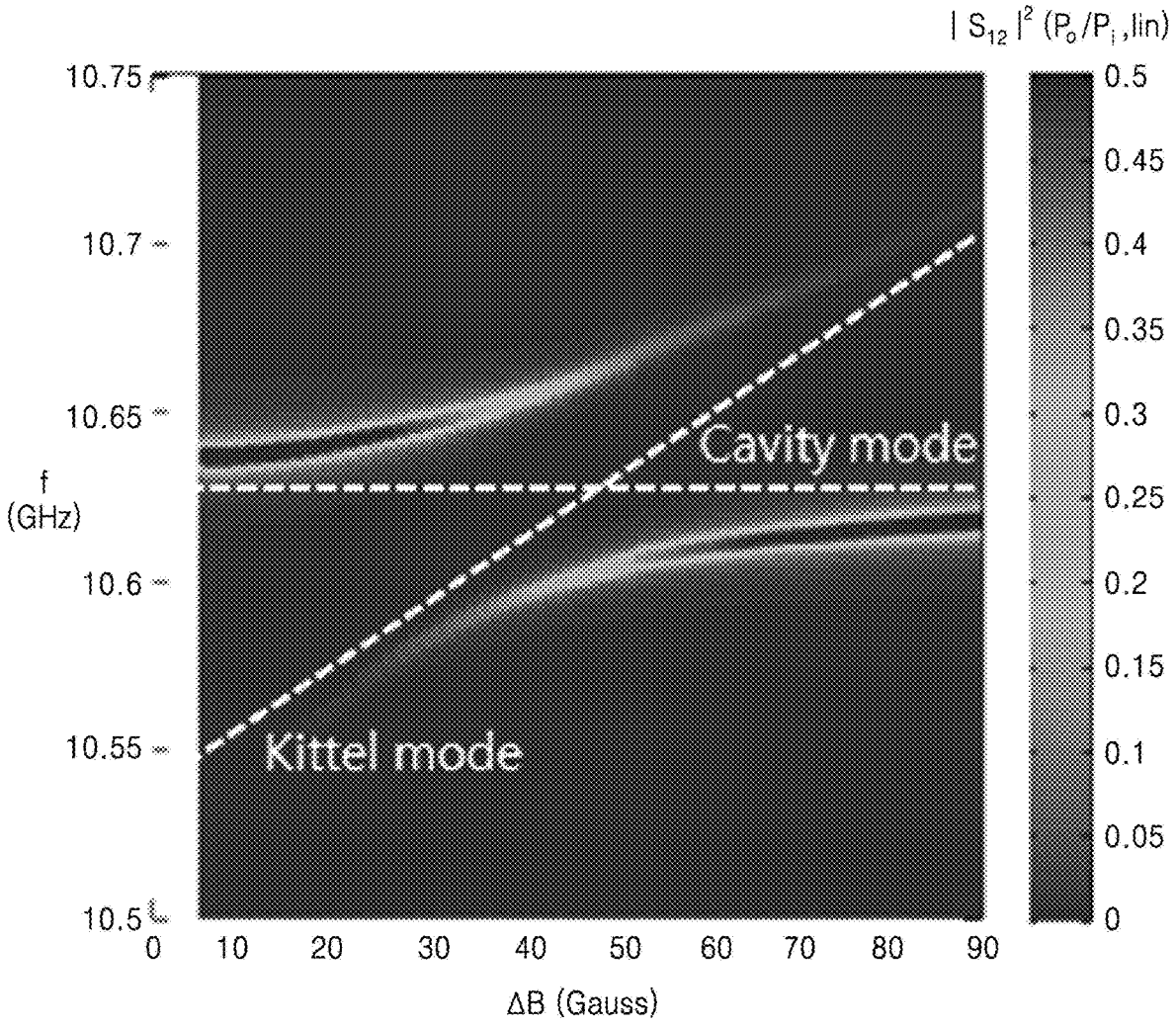
FIG. 10A illustrates a two-dimensional transmission spectrum obtained by a function of a microwave frequency and a magnetic field induced by a current in the magnetic field application system illustrated in FIG. 9.
Figure 10B:
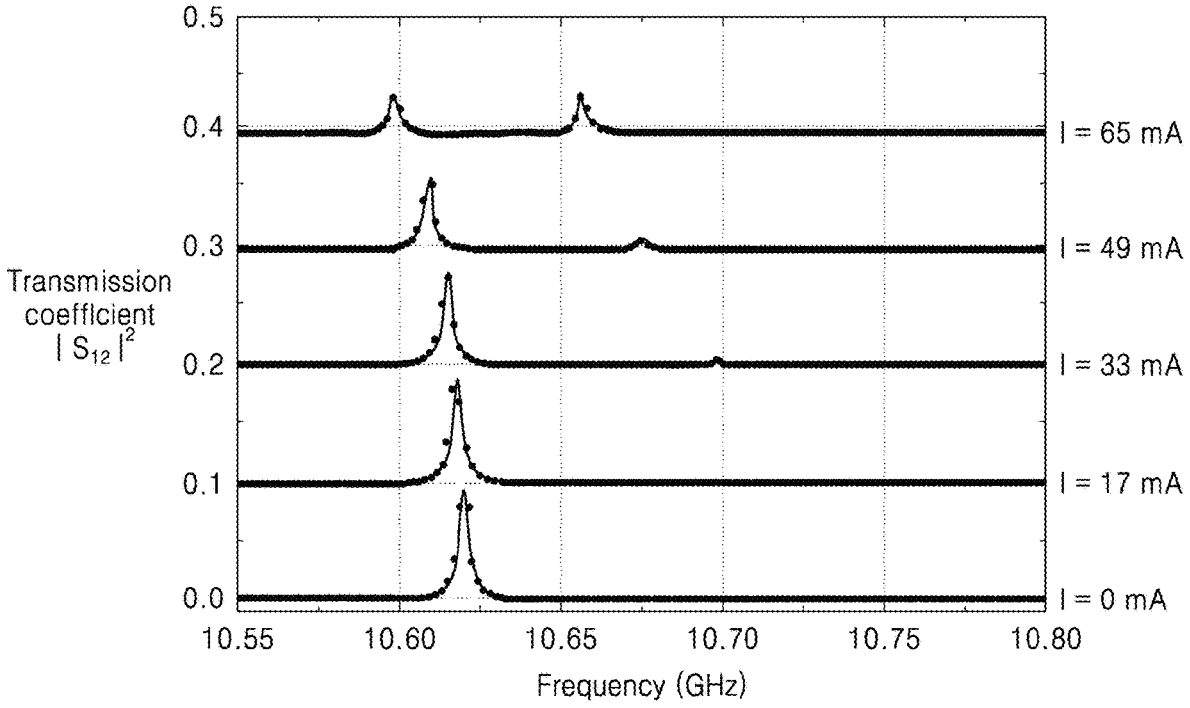
FIG. 10B is a graph showing a cross-sectional surface transmission spectrum corresponding to magnetic field offset values in a magnetic field in the magnetic field application system illustrated in FIG. 9.

FIG. 9 is a conceptual diagram of a magnetic field application system according to an embodiment shown in FIG. 2. In addition, FIG. 10A illustrates a two-dimensional transmission spectrum obtained by a function of a microwave frequency and a magnetic field induced by a current in the magnetic field application system illustrated in FIG. 9, and FIG. 10B is a graph showing a cross-sectional surface transmission spectrum corresponding to magnetic field offset values in a magnetic field in the magnetic field application system illustrated in FIG. 9. Referring to FIG. 9, the magnetic field application system 1000 includes a resonator 100, a magnetic field application device 200, a vector network analyzer 1100, and a computer 1200. The magnetic field application device 200 applies currents to the first coil assembly 210*a* and the second coil assembly 210*b* by means of a power supply 230 to generate a magnetic field. It may be seen that, when the magnetic field application system 1000 is configured as shown in FIG. 9, a coupling effect between the Kittel mode and the microwave resonator mode (or microwave cavity mode) is exhibited by the magnetic field application system 1000.

In detail, a microwave signal of 10.5~10.75 GHz is input to an input terminal of the microwave input and output unit 130 of the resonator 100. An output signal output according to the currents (or a magnetic field) applied to the first coil assembly 210*a* and the second coil assembly 210*b* is analyzed by the computer 1200 to obtain a transmission spectrum.

FIG. 10A shows a two-dimensional transmission spectrum obtained by a function of the magnetic field induced by the currents applied to the first coil assembly 210*a* and the second coil assembly 210*b* and a microwave frequency. It may be checked that normal mode separation is definite due to strong coupling between an excited spin mode (magnon), namely, a Kittel mode in the YIG single crystal and $TE_{101}$ mode of the resonator. A current conversion ratio relative to the magnetic field shows a linear relationship as shown in FIG. 6.

In FIG. 10A, a lateral dotted line denotes the resonant frequency of the resonator 100, and a diagonal dotted line shows a Kittel mode frequency. It may be seen that the Kittel mode approaches the resonator mode (or cavity mode) according to the change in the magnetic field applied externally, and the two modes are degenerated at a point of about 120 Gauss. Here, a frequency difference in a normal mode is about 60 MHz, and a magnon-cavity coupling mode is shown at this point.

FIG. 10B shows a cross-sectional surface transmission spectrum in magnetic fields corresponding to respective currents 0, 17, 33, 49, and 65 mA. Each point indicates experiment data, and solid lines indicate theoretical values obtained from the aforementioned theoretical equation of the coupling transmission coefficients. Consequentially, the coupling strength $g_m/2\pi$ of the spin mode and the resonator is 29 MHz, and the frequency and linewidth $\omega_{FMR}/2\pi$ and $\gamma_m/2\pi$ of the spin mode are respectively obtained as 10.623 GHz and 3.1 MHz. Consequentially, the embodiments enable the magnetic field to be applied more efficiently and linearly by adopting the magnetic field application system 100 including the magnetic field application device 200 provided with the pair of coil assemblies 210*a* and 210*b* on the basis of the resonator 100, and through this, a coupling technique may be obtained for a spin mode of a ferromagnetic material (YIG) and a microwave resonator mode. Meanwhile, the above numerical values are only exemplary, and the embodiments are not limited by the numerical values.

The aforementioned coupling technique enables frequency conversion between the microwave and the optical wave due to interaction with an optical beam. In other words, the resonator 100 may cause the frequency conversion between the microwave and the optical wave to occur by the magnetic field generated from the magnetic field application device 200.

Figure 11A:
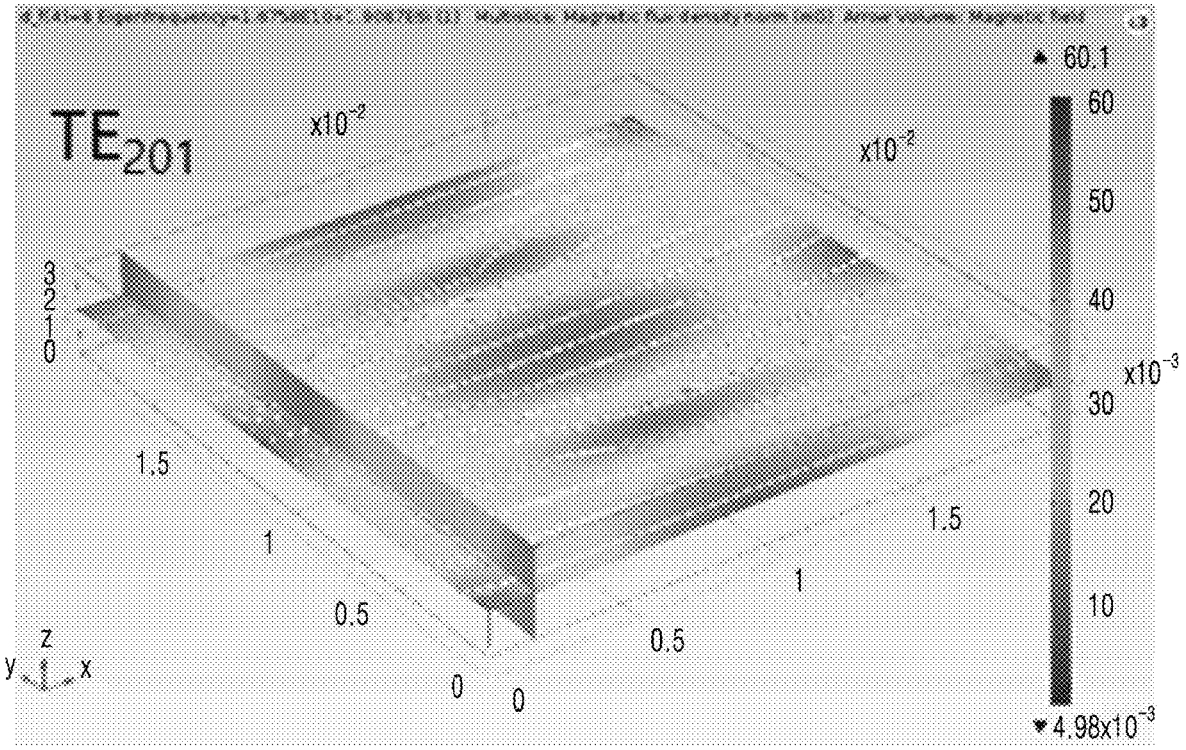
FIGS. 11A and 11B show magnetic field distributions in $TE_{201}$ mode excited in the resonator shown in FIG. 2.
Figure 11B:
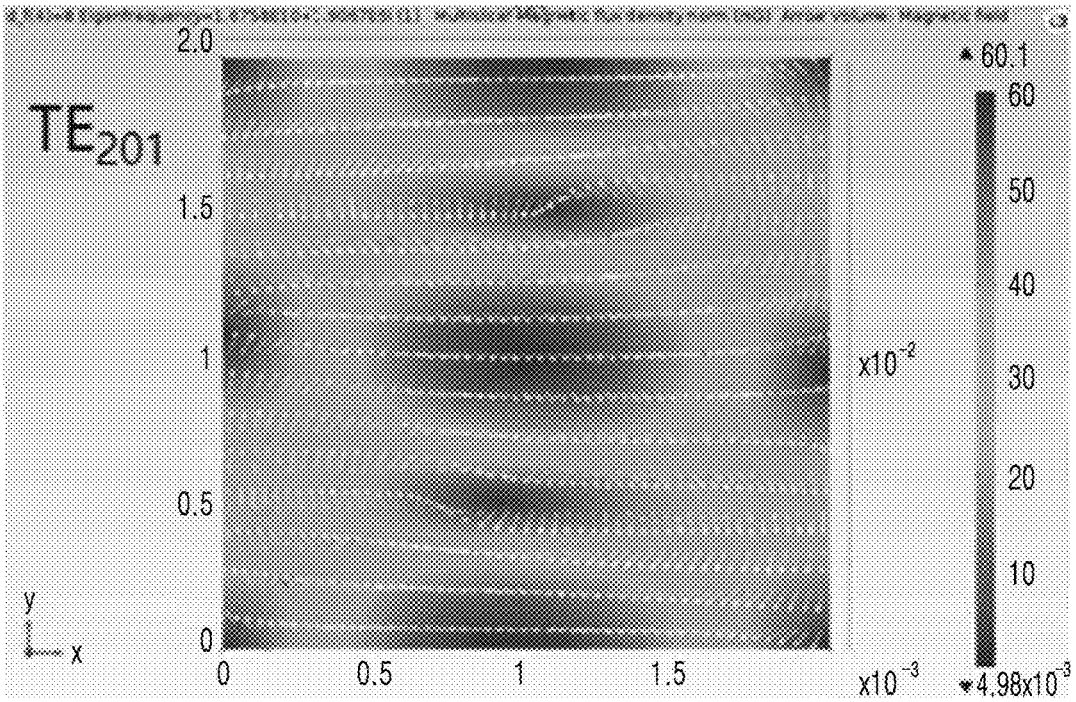

FIGS. 11A and 11B show magnetic field distributions in $TE_{201}$ mode excited in the resonator shown in FIG. 2, and FIGS. 12A to 12C show magnetic field distributions for respective modes obtained from cavities having thicknesses thicker than the resonator shown in FIG. 2.

Referring to FIGS. 11A to 12C, it may be seen that, on the basis of coupling between the ferromagnetic material (YIG) and the resonator 100, a coupling effect may be obtained between modes corresponding to various resonant frequencies of the resonator 100 and the spin mode of the ferromagnetic material.

FIGS. 11A and 11B show distributions of a magnetic field excited at a resonant frequency of 16.759 GHz in the theoretical simulation result. In other words, when $TE_{201}$ mode is coupled with the spin mode of the ferromagnetic material, a microwave in a higher frequency band may be converted to an optical wave.

Figure 12A:
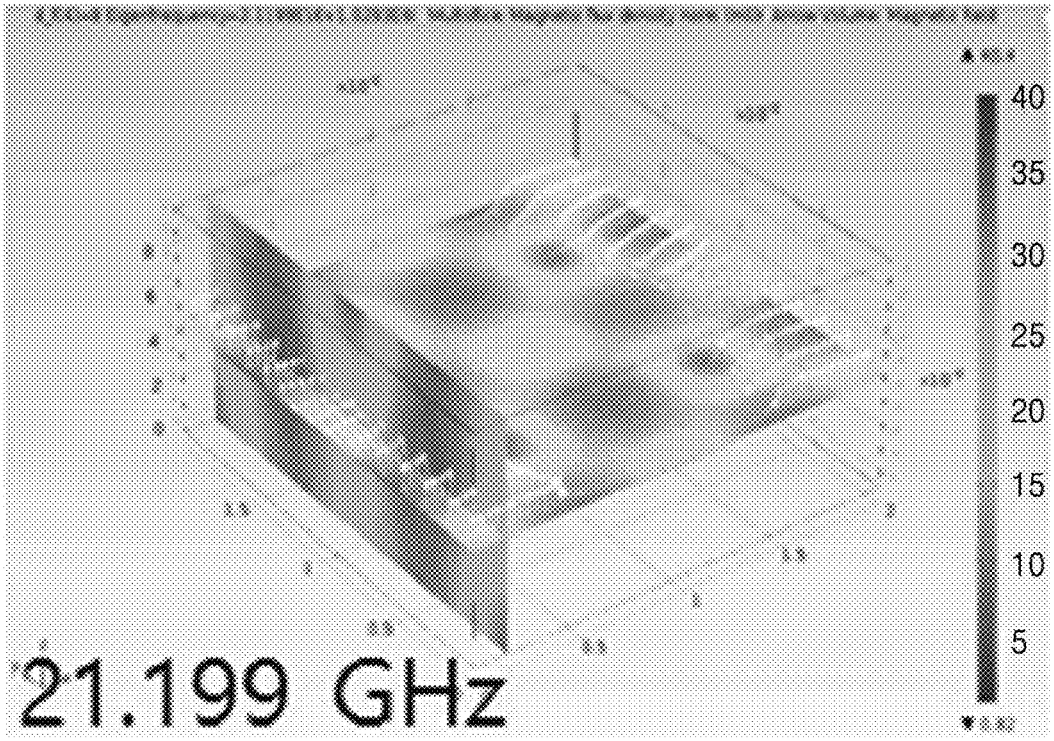
FIGS. 12A to 12C illustrate magnetic field distributions for respective modes obtained from cavities having respective thicknesses thicker than the resonator shown in FIG. 2.
Figure 12B:
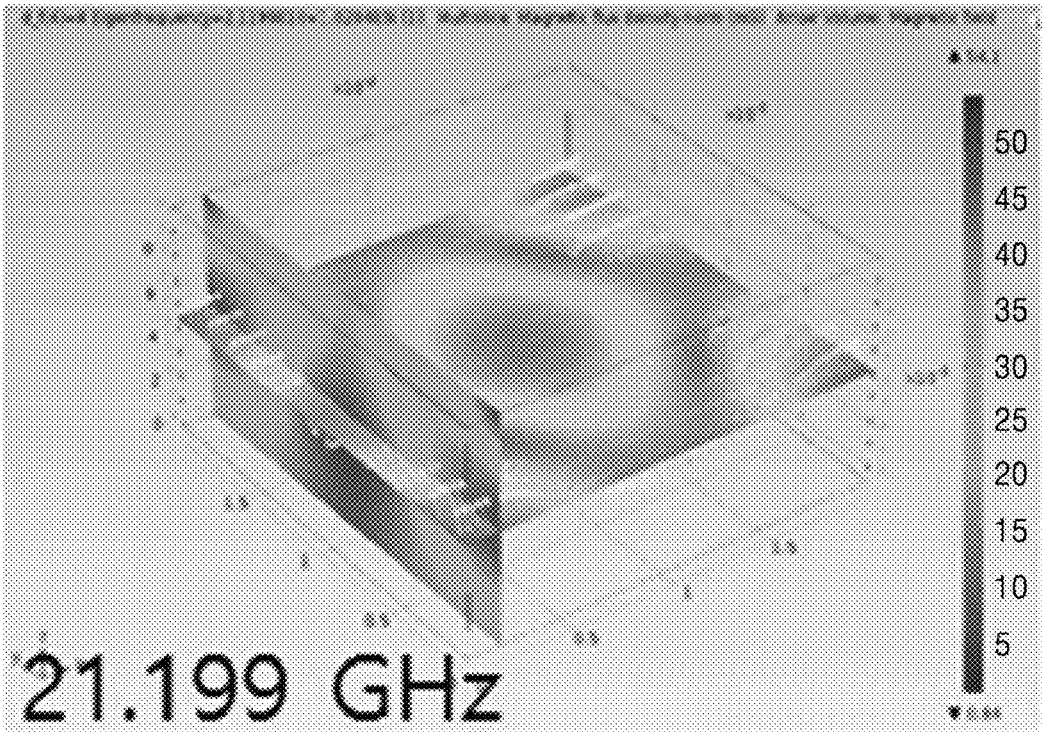
Figure 12C:
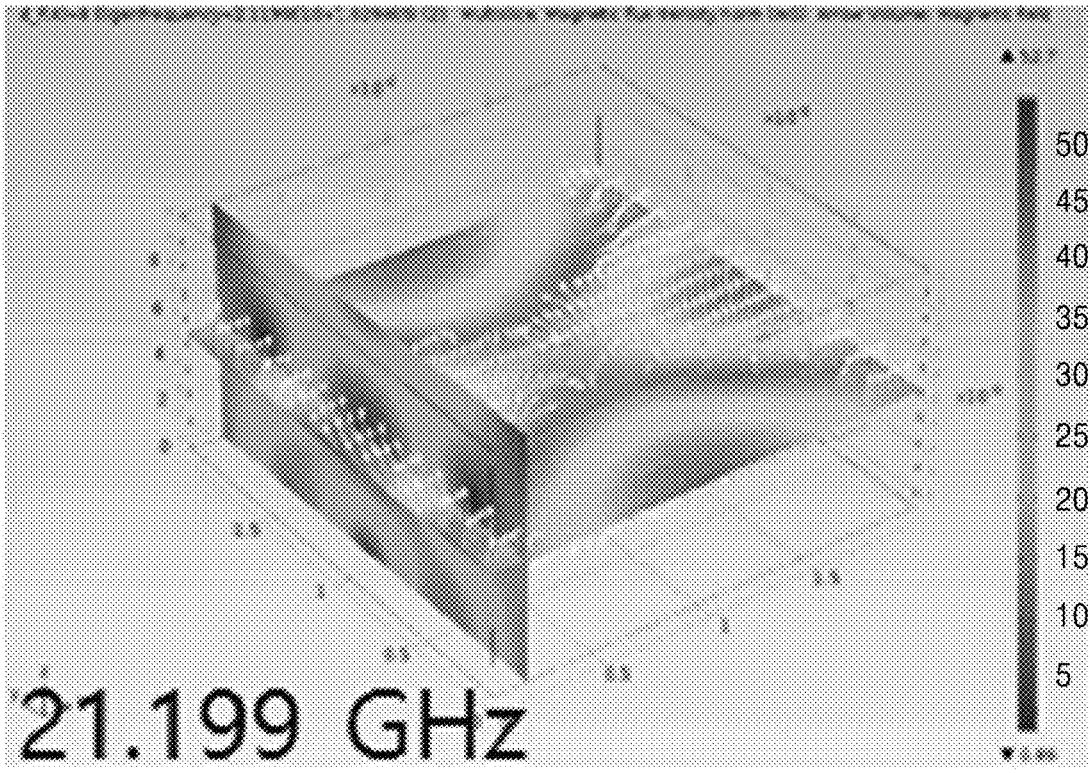

In addition, referring to FIGS. 12A to 12C, it may be seen that a microwave photon in a prescribed band in various modes other than $TE_{201}$ mode is converted to an optical wave photon by adjusting the thickness of the resonator 100.

For example, in the embodiment shown in FIG. 2, the thickness of the resonator 100 is 3 mm, and the thickness of the resonator 100 for exhibiting the magnetic field distributions shown in FIGS. 12A to 12C is 10 mm. FIGS. 12A to 12C show $TE_{202}$ mode of the resonator 100. Referring to these, as the thickness of the resonator 100 becomes smaller, the intensity of the magnetic field increases to make it advantageous in quantum coupling. In addition, resonator modes of higher resonant frequencies are capable of being quantum-coupled (quantum mechanical interaction) with magnon modes of higher frequencies.

Accordingly, in the resonator 100, a frequency conversion band between the microwave and the optical wave may be adjusted according to 3-D dimensions (length, thickness, height, and the like) of the main body 110.

According to the embodiments, a magnetic field application device and a magnetic field application system including the same may generate a magnetic field having the slope as well as a linear change therein with respect to a current supplied by a pair of coil assemblies spaced from each other in parallel. Accordingly, coupling and multi-mode quantum frequency conversion can be obtained between a multi-magnon (spin) mode of a ferromagnetic material (YIG) and a microwave resonator mode.

The effects of the present invention are not limited to the above mentioned effects, and other effects not mentioned above may be clearly understood through the description and the accompanied drawings by those skilled in the art.

It should be understood that embodiments described herein should be considered in a descriptive sense only and not for purposes of limitation. Descriptions of features or aspects within each embodiment should typically be considered as available for other similar features or aspects in other embodiments. While one or more embodiments have been described with reference to the figures, it will be understood by those of ordinary skill in the art that various changes in form and details may be made therein without departing from the spirit and scope of the disclosure as defined by the following claims.

What is claimed is:

1. A magnetic field application device comprising:

a first coil assembly and a second coil assembly spaced apart in parallel from each other;

a power supply configured to apply respective currents to the first coil assembly and the second coil assembly;

a controller; and a resonator accommodation unit disposed between the first coil assembly and the second coil assembly, wherein the controller is configured to control the currents applied from the power supply to the first coil assembly and the second coil assembly, and wherein each of the first coil assembly and the second coil comprises:

a coil configured to generate a magnetic field;

a guide member connected to the coil;

a magnetic material mount connected to the guide member; and a magnetic material fixed to the magnetic material mount.

2. The magnetic field application device according to claim 1, further comprising:

a base in which the resonator accommodation unit is formed; and a support unit disposed on a top portion of the base to support the first coil assembly and the second coil assembly, wherein respective coils of the first coil assembly and the second coil assembly are coaxial.

3. The magnetic field application device according to claim 1, wherein the first coil assembly and the second coil assembly are symmetrically arranged with respect to resonator accommodation unit.

4. The magnetic field application device according to claim 1, wherein the controller is configured to control the respective currents applied to the first coil assembly and the second coil assembly independently.

5. A magnetic field application system comprising:

a magnetic field application device, wherein the magnetic field application device comprises a first coil assembly and a second coil assembly spaced apart in parallel from each other, a power supply configured to apply respective currents to the first coil assembly and the second coil assembly, a resonator accommodation unit disposed between the first coil assembly and the second coil assembly and a controller configured to control the currents applied from the power supply to the first coil assembly and the second coil assembly; and a resonator disposed in the resonator accommodation unit of the magnetic field application device, wherein the resonator comprises:

a main body;

a penetration opening formed in the main body; and an Yttrium Iron Garnet single crystal disposed in the penetration opening, wherein the penetration opening of the resonator is disposed between the first coil assembly and the second coil assembly of the magnetic field application device.

6. The magnetic field application system according to claim 5, wherein the resonator receives inputs and outputs of a microwave and an optical wave, and causes frequency conversion between the microwave and the optical wave to occur by the magnetic field generated by the magnetic field application device.

7. The magnetic field application system according to claim 6, wherein the resonator further comprises:

a microwave input and output unit configured to receive the input and output of the microwave;

an optical wave input unit configured to receive an input of the optical wave; and an optical wave output unit configured to output the frequency-converted optical wave.

8. The magnetic field application system according to claim 5, wherein the resonator comprises a plurality of Yttrium Iron Garnet (YIG) single crystals, wherein the plurality of YIG single crystals are arranged in parallel in a direction from one between the first coil assembly and the second coil assembly toward another.

9. The magnetic field application system according to claim 5, wherein, in the resonator, a frequency conversion band between a microwave and an optical wave is adjusted according to 3-D dimensions of the main body.

10. The magnetic field application system according to claim 5, wherein the controller is configured to apply respective different currents to the first coil assembly and the second coil assembly to adjust a slope of the magnetic field applied to the resonator.

11. The magnetic field application system according to claim 5, wherein the magnetic field application device further comprises:

temperature sensors configured to sense temperatures of respective coils in the first coil assembly and the second coil assembly, wherein the controller is configured to adjust an amount of generation of the magnetic field on the basis of the temperatures sensed by the temperature sensors.

12. The magnetic field application system according to claim 11, wherein the controller is configured to control the currents applied to the first coil assembly and the second coil assembly so that a resonant frequency of the resonator is constant.

* * * * *